US006778791B2

(12) United States Patent
Shimizu et al.

(10) Patent No.: US 6,778,791 B2
(45) Date of Patent: Aug. 17, 2004

(54) IMAGE FORMING APPARATUS HAVING CHARGING ROTATABLE MEMBER

(75) Inventors: Yasushi Shimizu, Shizuoka-ken (JP); Junichi Kato, Shizuoka-ken (JP); Hiroshi Satoh, Mishima (JP); Masahiro Yoshida, Yokohama (JP); Hiroyuki Oba, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/132,373

(22) Filed: Apr. 26, 2002

(65) Prior Publication Data

US 2002/0181970 A1 Dec. 5, 2002

(30) Foreign Application Priority Data

Apr. 27, 2001 (JP) ..... 2001/132165

(51) Int. Cl.[7] ..... G03G 15/00; G03G 15/02

(52) U.S. Cl. ..... 399/75; 399/150; 399/174

(58) Field of Search ..... 399/149, 174, 399/175, 176, 75, 150

(56) References Cited

U.S. PATENT DOCUMENTS

| | | | | |
|---|---|---|---|---|
| 5,066,979 | A | 11/1991 | Goto et al. | 355/208 |
| 5,353,104 | A | 10/1994 | Kato et al. | 355/259 |
| 5,519,472 | A | 5/1996 | Ojima et al. | 355/246 |
| 5,682,585 | A | 10/1997 | Yamaguchi et al. | 399/274 |
| 5,805,951 | A | 9/1998 | Kato et al. | 399/26 |
| 5,809,379 | A | 9/1998 | Yano et al. | 399/159 |
| 6,035,150 | A | 3/2000 | Domon et al. | 399/27 |
| 6,081,681 | A | 6/2000 | Nagase et al. | 399/174 |
| 6,128,456 | A | 10/2000 | Chigono et al. | 399/176 |
| 6,134,407 | A | 10/2000 | Ishiyama et al. | 399/174 |
| 6,163,663 | A | 12/2000 | Shinohara et al. | 399/55 |
| 6,167,212 | A | 12/2000 | Satoh et al. | 399/55 |
| 6,226,464 | B1 | 5/2001 | Suwa et al. | 399/27 |
| 6,272,306 | B1 | 8/2001 | Saito et al. | 399/270 |
| 6,370,348 | B1 | 4/2002 | Okano et al. | 399/256 |

FOREIGN PATENT DOCUMENTS

| | | | |
|---|---|---|---|
| JP | 6-3921 | | 1/1994 |
| JP | 2000-39754 A | * | 2/2000 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes a rotatable image bearing member; a charging rotatable member, contactable to the image bearing member at a contact position, for electrically charging the image bearing member, the charging rotatable member being rotatable for counterdirectional peripheral movement relative to rotation of the image bearing member at the contact position; developing means for developing an electrostatic image formed on the image bearing member with a developer, the developing means being capable of collecting a residual developer from the image bearing member; and wherein start of rotation of the charging rotatable member is simultaneous with or prior to start of rotation of the image bearing member.

17 Claims, 13 Drawing Sheets

IMAGE FORMING APPARATUS HAVING CHARGING ROTATABLE MEMBER

FIELD OF THE INVENTION AND RELATED ART

The present invention relates to an image forming apparatus such as an electrophotographic apparatus, electrostatic recording apparatus or the like using a contact charging type charging device for electrically charging an image bearing member such as an electrophotographic photosensitive member, dielectric member for electrostatic recording or the like, more particularly to a cleanerless type image forming apparatus which is not provided with a cleaner exclusively for cleaning the image bearing member. The image forming apparatus such as an electrophotographic apparatus requires an electric charging step of charging the image bearing member uniformly to a predetermined potential in order to form an electrostatic latent image on the image bearing member For this purpose, a non-contact type corona charger or the like has been used as a means for the charging.

However, the corona charger produces ozone and requires such a high voltage as approx. 10 KV has to be applied between the charging device and the image bearing member.

Recently, a charging means has been proposed to avoid these problems. In such a means, a charge member is directly contacted to the image bearing member and is supplied with a voltage by which the image bearing member is charged uniformly (so-called contact charging device).

Referring first to FIG. 5, there is shown a typical contact charging device is a charging roller 2-X. S charging roller 2-*x* comprises an electroconductive base roller, an intermediate resistance surface layer, and the roller is rotated by t image bearing member 1 in the codirectional peripheral movements in the direction indicated by arrow f (rotational direction a). Between the roller and the image bearing member 1, a predetermined voltage is applied from a voltage source S1, so that said image bearing member 1 is electrically charged to a uniform potential.

Here, the voltage applied to the roller may be (1) a DC voltage only or (2) a DC voltage biased with an AC voltage.

(1) In the case of (1), in order to charge the image bearing member 1 to a potential of −600V, the applied voltage is approx. −1300V, and in the case of (2), the applied DC voltage is −600V and the AC voltage is not less than 1500 Vpp.

The charging mechanism in these cases is based on the Paschen's law, and an electric discharge phenomenon arises in a region satisfying the Paschen's law in which the distance between the charging roller 2-X-a and the image bearing member 1 is within a predetermined range (region H in FIG. 5).

However, as will be understood from the charging mechanism, the contact charging device of this type creates the discharge which is the same as with the corona charger within a fine space region H, and therefore, the ozone is produced although the amount of ozone production is remarkably smaller than with the corona charger. The ozone produces nitrogen oxide, and if it is deposited on the image bearing member 1, an image defect is produced due to the low resistance of the deposited matter.

This injection charging process system is proposed in U.S. Pat. Nos. 6,134,407 or 6,081,681 and 6,128,456 in which is free of such a problem of ozone generation, and therefore, the voltage applied to the charging device can be further reduced.

The feature of the charging process is that surface potential of the charged image bearing member is substantially the same as the voltage applied to the charging device. This system does not use the electric discharge phenomenon, and charge injection occurs into the image bearing member by the transfer of electric charges between the surface of the image bearing member and the charge member contacted thereto.

FIG. 6 is a schematic view of a major part of the injection charging device 2. A charging sponge roller 2-A (charging roller) of an electroconductive sponge carries electroconductive particles Z deposited on its surface and rotates in such a direction that surface there is moved counterdirectionally (b) relative to the peripheral moving direction (a) of the image bearing member 1 at a nip C formed between t image bearing member 1 and the charging sponge roller, while injecting charge into the image bearing member 1 from the charging sponge roller 2-A. By this, the image bearing member 1 is charged to a potential substantially equal to the potential of the charging sponge roller 2-A.

The electroconductive particle are fine electroconductive particles (charging-promotion particle) for assisting the charging. The electroconductive particles are metal oxide fine particles of electroconductive zinc oxide or the like having a volume resistivity of not more than $1\times10^{12}$ Ω.cm, preferably not more than $1\times10^{10}$ Ω.cm, with or without electroconductive inorganic fine particles, organic material mixed therewith.

In this system, the charging sponge roller 2-A is supplied with a DC voltage of −600V from a voltage source S1. Therefore, the surface potential of the image bearing member 1 tends to become the same potential at the portions where the charging sponge roller 2-A and the electroconductive particle Z are contacted. At this time, if the charge is injected into the image bearing member 1 from the charging sponge roller 2-A side beyond an energy barrier on the surface of the image bearing member 1, the image bearing member 1 is electrically charged. If not, or if the charge moves back from the image bearing member 1 to the charging sponge roller 2-A side at positions where the charging sponge roller 2-A and the image bearing member 1 are apart from each other, the image bearing member 1 is not charged. This phenomenon is dependent on the energy barrier of the surface of the image bearing member 1 and/or the charge retention power. On the other hand, when it is taken as a competitive reaction, a frequency of chance of contact between the charging sponge roller 2-A side and the image bearing member 1 is important. In order to increase the frequency, electroconductive particle Z having small particle sizes are deposited on the surface of the charging sponge roller 2-A so as to increase the injection sites in the contact portion C between the image bearing member 1 and the charging sponge roller 2-A, and in addition, the charging sponge roller 2-A is rotated in the peripheral counterdirectional direction so as to increase the relative speed between the image bearing member 1 and the charging sponge roller 2-A, thus increasing the number of contact to the image bearing member 1 in the injection sites per unit time.

In this manner, the charging sponge roller 2-A and the electroconductive particle Z which establish injection sites of the charge to the image bearing member 1 are contacted to the image bearing member 1 at high opportunity, so that surface potential of the image bearing member 1 becomes substantially the same potential, that is, −600V applied to the charging sponge roller 2-A. Microscopically, uniform charging is accomplished.

FIG. 7 is a schematic view of an example of a transfer type electrophotographic apparatus of a cleaner-less system type wherein the charging means for the image bearing member 1 is an injection charging device 2 using the electroconductive particles Z as described above, and no cleaner exclusively for cleaning the image bearing member 1 is used.

Designated by reference numeral 1 is an electrophotographic photosensitive member of a rotatable drum type (image bearing member), wherein rotated at a predetermined peripheral speed in the clockwise direction indicated by an arrow a. Designated by 2-A is a charging sponge roller, which is contacted to the image bearing member 1 with a predetermined urging force to provide a contact portion (charging nip) C having a predetermined width. On the outer surface of the charging sponge roller 2, charging sponge rollers 2 are deposited beforehand. The charging sponge roller 2 is rotated in the clockwise direction indicated by an arrow b, by which the charging sponge roller 2 is rotated counterdirectionally with respect to the peripheral movement of the image bearing member 1 at the contact portion C relative to the image bearing member 1, and the charging sponge roller 2 is supplied with a predetermined charging bias from the voltage source S1, by which the outer surface of the image bearing member 1 is uniformly charged by charge injection to a predetermined potential of a predetermined polarity.

The surface of the image bearing member 1 thus uniformly charged is exposed to image light L by unshown exposure means (digital scanning exposure device such as a laser beam scanner or the like, image projecting device for projecting an image of an original document, so that electrostatic latent image is formed corresponding to the exposure image pattern on the uniformly charged surface of the image bearing member 1.

Then, the electrostatic latent image is visualized into a developed image (toner image) by a developing sleeve 3-*a* in a jumping developing device 3 of a non-contact type. Designated by S2 is a voltage source for applying a predetermined developing bias voltage to the developing sleeve 3-*a*.

Then, the developed image is transfer, at a transfer portion where a transfer roller 5-*a* of a transferring device 5 is contacted to the image bearing member 1 onto a transfer sheet P (recording material sheet fed from an unshown sheet feeder at predetermined controlled timing. Designated by S3 is a voltage source for applying a predetermined transfer bias to the transferring device 5.

The recording material P is separated from the image bearing member 1 after receiving the developed image at the transfer portion and is introduced into an unshown fixing device, where the image is fixed. Then, the recording material P is discharged as a print (or copy).

After the separation of the recording material, the residual developer remaining on the surface of the image bearing member 1 is carried back to the developing zone by way of the continuing rotation of the image bearing member 1, and is collected into the developing device 3 (simultaneous development and cleaning).

Here, the electroconductive particle retaining force of the charging sponge roller 2-A is not so strong, and therefore, a system for stably supplying the electroconductive particles Z to the charging sponge roller 2-A is provided. In this system, the electroconductive particles Z are mixed in the developer T in the developing container 3-*d* of the developing device 3, so that electroconductive particles Z are supplied to the charging sponge roller 2-A by way of the image bearing member 1, that is, supplied to the image bearing member 1 through the non-contact jumping developing device 3 and then carried on the image bearing member 1 to the position of the charging sponge roller 2-A.

In the non-contact jumping developing device 3, the electroconductive particles Z are supplied when the developer T is supplied to the image bearing member 1 for development. The charging polarity of the electroconductive particles Z is selected so as to be opposite the regular charging polarity of the developer T, so that they are not transferred onto the transfer sheet P by the transfer roller 5-*a* but remains on the image bearing member 1. Then, they are collected by the sponge roller 2-A which is rotating counterdirectionally relative to peripheral movement of the image bearing member 1.

This system is a so-called cleaner-less system in which no cleaning process for collecting the developer T between the charging step and the transfer step in the image formation process. If an attempt is made to implement the cleaner-less system of this Examiner in a conventional type contact charging device or the like described above, the residual developer T after the transfer step appears as it is in the next formed image. In this example, however, the charging sponge roller 2-A of the elastic member is rotated in the counterdirectional peripheral movement relative to the image bearing member 1, the residual developer T is scraped, and therefore, no influence is imparted to the next image. Most of the developer T deposited on the charging sponge roller 2-A is discharged to the image bearing member 1 at a relatively early stage, and thereafter is collection into the developing device 3 when it passes through the developing zone. Therefore, the cleanerless electrophotographic process is accomplished.

Referring to FIGS. 8 and 9, the description will be made in detail as to the effect of the counterdirectional rotation of the charging sponge roller 2-A in the cleaner-less system, will be described. (a) if the charging sponge roller 2-A is rotated in the codirectional peripheral movement, the developer T on the image bearing member 1, is deposited to the charging sponge roller 2-A during the passage thereof through the contact portion C, and the amount of the developer T decreases. But, the previous image pattern still remains as it is, and would result in the image defect in the next image. (b) if the charging sponge roller 2-A is not rotated, the developer T, as shown in FIG. 8, stagnates at the inlet portion J of the contact portion C. When the amount of the stagnated developer reaches a predetermined amount, the developer T enters the contact portion C, and therefore, the charging property lowers.

On the other hand, in the case of the counterdirectional rotation, the developer T, as shown in FIG. 9, is scrapped off the image bearing member 1, and therefore, the developer T deposited on the image bearing member 1 before the passing through the contact portion C relative to the charging sponge roller 2-A is not present on the image bearing member 1 after passing through the upper. The developer T scraped off the image bearing member 1 is not directly deposited onto the charging sponge roller 2-A surface, but is once stagnated at the inlet portion J of the contact portion C.

As indicated by an arrow j in the Figure, behavior of the developer is moved to the charging sponge roller 2-A while making a circulating motion by the feeding force provided by the surface of the image bearing member 1 and by the feeding force provided by the surface of the charging sponge roller 2-A, so that said image pattern does not remain as it is on the charging sponge roller 2-A.

The amount of the developer T moving to the charging sponge roller 2-A is different depending on the cases, for example, the amount of the residual developer T is large after development of a black image image so that large amount of the developer T comes to the J portion, or the latent image potential a position J changes. However, in normal use, it does not occur that large amount of the toner moves at once to the charging sponge roller 2-A. For this reason, these situations does not result in the improper charging or the image defect because of the developer T movement from the charging sponge roller 2-A to the image bearing member 1.

Most of the developer T is electrically charged to the positive polarity by the transfer step, but is charged to the negative polarity relatively quickly because of the triboelectric charge in the J portion, the negative bias voltage application in the charging step.

Thereafter, most of the developer T is carried on the charging sponge roller 2-A, but is moved to the image bearing member 1 at the outlet portion K of the contact portion C between the image bearing member 1 and the charging sponge roller 2-A. As described in the foregoing, the developer T on the charging sponge roller 2-A is charged to the negative polarity. In addition, when the comparison is made between the potential of the surface of the image bearing member 1 at said K portion and a potential of the charging sponge roller 2-A, the potential of the charging sponge roller 2-A is relatively at the negative side even if it may be slightly so.

The developer T having moved to the image bearing member 1 before it enters the contact portion C between the image bearing member 1 and the charging sponge roller 2-A, is fed to the developing device away from the contact portion C by the feeding force of the image bearing member 1. For this reason, most of the developer T does not enter the contact portion C, and the deterioration of the charging property does not occur.

As compared with the behavior of the electroconductive particle Z, the developer T does not easily enter the contact portion C because or the particle sizes thereof as well as the charging polarity, and therefore, only the electroconductive particles Z tend to be present at the portion. Therefore, satisfactory charging property can be provided.

(I) The state at the time of start of the image forming step is particularly considered in implementing an image forming process using the injection charging device 2, when the start of the rotation of the image bearing member 1 is earlier than the start of the rotation of the charging sponge roller 2-A, the situation is the same as with the case in which the charging sponge roller 2-A does not rotate (b). In normal use, the residual developer T does not present on the image bearing member 1 at the initial start. If, however, the amount of the developer T discharged on the image bearing member 1 from the transfer roller 5-*a* during the cleaning process for the transfer roller 5-*a* in the transferring device 5 after the image formations, is large, or if a transfer sheet P is jammed, a large amount of the developer T stagnates at the inlet portion J of the contact portion C. If this occurs, the charging property is temporarily deteriorated as described in the foregoing (b), and in addition, at the contact portion C between the image bearing member 1 and the charging sponge roller 2-A, the developer T might be embedded into the charging sponge roller 2-A, and therefore, developer T is not easily separated from the charging sponge roller 2-A with the result of continuing local improper charging. When the rotation of the charging sponge roller 2-A starts, the developer T stagnated at the J portion is fed at once to the charging sponge roller 2-A, and the resistance change on the charging sponge roller 2-A occurs with the result of change in the charged potential which leads to charging non-uniformity. Because the large amount of the developer T is supplied to the image bearing member 1, image defect will be produced in some cases.

The case that few amount of the developer T is present on the image bearing member 1 or the J portion at the time of the start will be considered. When a large amount of the electroconductive particles Z for increasing the charging performance are present thereat, they are concentrated at the J portion, and electroconductive particles Z having small particle sizes are embedded into the charging sponge roller 2-A by the feeding force provided by the rotation of the image bearing member 1. Only the portions of the charging sponge roller 2-A that is supplied with a larger amount of the electroconductive particles Z with the rotation of the charging sponge roller 2-A, has a low resistance, that is, a high charging performance, with the result of high latent image potential portions in the form of stripes and therefore non-uniform image.

In order to solve the problem, the amounts of the developer T and the electroconductive particles Z at the J portion at the time of the start of the image forming process is made always stabilize. It would be considered that developer T collecting operation in the developing process is continued while performing the charging step without performing the cleaning process for the transfer roller 5-*a* or the image forming process. In such a case, the post-rotation step which is executed after the image forming operation requires a long time, in order to solve the problem, the amounts of the developer T and the electroconductive particles Z at the J portion at the time of the start at image forming process is made always stabilize. It would be considered that developer T collecting operation in the developing process is continued while performing the charging step without performing the cleaning process for the transfer roller 5-*a* or the image forming process. In such a case, the post-rotation step which is executed after the image forming operation requires a long time.

Since the charging sponge roller 2-A is made of elastic material, the charging sponge roller 2-A easily deforms at the contact portion C relative to the image bearing member 1 if the image forming apparatus is kept in a non-operative state for a long term. In the normal use, the change in the charging state resulting from the change of the configuration is not as significant as being the influential to the resultant image. However, the tendency toward said improper charging is overlaid on the deformed portion, the improper charging may easily occurs at the deformed portion.

If a relatively large amount of the developer T exists at the J portion after the end of the previous image forming process, or the like, a large amount of the developer T stagnates at the K portion after one full-turn of the charging sponge roller 2-A before the rotation of the image bearing member 1 as shown in FIG. 10. If only the rotation of the charging sponge roller 2-A continues, the developer T at the K portion enters the contact portion C between the image bearing member 1 and the charging sponge roller 2-A by the feeding force of the charging sponge roller 2-A, with the result of tendency of the improper charging.

The case that charging step is carried out with the system (1) using an electroconductive brush roller 2-B, as shown in FIG. 11, supplied with a DC voltage, will be considered. If the image bearing member 1 is rotated without rotation of the electroconductive brush roller 2-B, a large amount of the developer T may be carried to the contact portion C between the image bearing member 1 and brush roller 2-B, and the developer may enter the contact portion C of the brush roller 2-B. The developer is not easily separated from the inside of the brush, and no electroconductive particle as are supplied from the outside, and therefore, the resistance of the brush roller only at such a position continues to be high even if the brush roller rotates. This would result in the non-uniform charging and therefore non-uniform image. (II) The ending stage of the image forming process executed using the injection charging device 2 will be considered. When the rotation of the charging sponge roller 2-A is stopped earlier than the stop of rotation of the image bearing member 1, the situation is the same as with (b) described above, that is, the case that charging sponge roller 2-A does not rotate. In this case, when a cleaning process for the transfer roller 5-*a* of the transferring device 5 is carried out after a series of image formations process, and the amount of the developer T discharged from transfer roller 5-*a* onto the image bearing member 1 is large, a large amount of the developer T stagnates at the inlet portion J of the contact portion C, as described hereinbefore.

When the transfer sheet P jam or the like occurs in the image forming apparatus, recovery sequential operations are normally carried out, including cleaning sequential operations for removing the large amount of the developer T remaining on the image bearing member. However, it is difficult to remove the developer T from the image bearing member 1 to reduce the amount of the developer down to a normal level in a short period of time. Therefore, in many cases, the amount of the developer T is larger than in the normal state even if no image defect results.

Therefore, in this case, too, the similar problems arise when the stop of rotation of the charging sponge roller 2-A is earlier than the stopover rotation of the image bearing member 1.

At the contact portion C between the image bearing member 1 and the charging sponge roller 2-A, the developer T is embedded into the charging sponge roller 2-A, and developer T is not easily separated from the charging sponge roller 2-A there. In the subsequent image forming operations, local improper charging may occur there.

When the rotation of the image bearing member 1 starts with the state, a large amount of the developer is deposited to the portion which took the position J at the time of start of the rotation as shown in FIG. 12, with a result of change of the charged potential at that portion and therefore non-uniform charging. Or, a large amount of the developer T is altogether supplied to the image bearing member 1 with the result of image defect.

That case that few amount of the developer T is present at the J portion or on the image bearing member 1 will be considered. When a large amount of the electroconductive particles Z for enhancing the charging property is present at that portion, a large amount of the electroconductive particles Z are collected at the J portion, and electroconductive particles Z having small particle sizes are embedded into the charging sponge roller 2-A by the feeding force provided by the rotation of the image bearing member 1. Only the portions of the charging sponge roller 2-A that is supplied with a larger amount of the electroconductive particles Z with the rotation of the charging sponge roller 2-A, has a low resistance, that is, a high charging performance, with the result of high latent image potential portions in the form of stripes and therefore non-uniform image.

In the case of use of elastic material for the charging member, as shown in FIG. 13, the deformation and/or the contact pressure of the charging sponge roller 2-A are different between when the image bearing member 1 is rotated ((a) of FIG. 13) and when it is not rotated ((b) of FIG. 13). Generally, the area at the contact portion C is larger when the image bearing member 1 is not rotated. For this reason, there is a portion which is the J portion during rotation but is the contact portion C after the stop.

Therefore, when a large amount of the developer T and the electroconductive particles Z are supplied to the J portion, and the portion becomes a contact portion C between the image bearing member 1 and the charging sponge roller 2-A, the particle are embedded into the charging sponge roller 2-A. If such a state is kept for a long term, the contact pressure thereat becomes high with the result of the particles are embedded in a further extended and therefore further difficulty or discharge, that is, persistent non-uniformity in the charging.

Furthermore, if the apparatus is not operated for a long term under a high temperature ambience, a large amount of low resistance electroconductive particles at the contact portion C causes memory effect of charge on image bearing member 1, by which the sensitivity of the image bearing member 1 is locally different with the result of image defect.

In addition, the charging sponge roller 2-A is made of elastic material, and therefore, if the image forming apparatus is not operated for a long term, the charging sponge roller 2-A may deform at the contact portion C between the image bearing member 1. In the normal use, the change in the charging state resulting from the change of the configuration is not as significant as being the influential to the resultant image. However, the tendency toward said improper charging is overlaid on the deformed portion, the improper charging may easily occurs at the deformed portion.

In order to solve the problem, the amounts of the developer T and the electroconductive particles Z at the J portion at the time of the start of the image forming process is wade always stabilize. It would be considered that developer T collecting operation in the developing process is continued while performing the charging step after performing the cleaning process for the transfer roller 5-*a* after the image forming process. In such a case, however, the post-rotation step which is executed after the image forming operation requires a long time.

If a relatively large amount of the developer T exists at the J portion after the end of the previous image forming process, or the like, a large amount of the developer T stagnates at the K portion after one full-turn of the charging sponge roller 2-A after stop of the image bearing member 1 as shown in FIG. 10. If only the rotation of the charging sponge roller 2-A continues, the developer T at the K portion enters the contact portion C between the image bearing member 1 and the charging sponge roller 2-A by the feeding force of the charging sponge roller 2-A, with the result of tendency of the improper charging.

The case that charging step is carried out with the system (1) using an electroconductive brush roller 2-B, as shown in FIG. 11, supplied with a DC voltage will be considered. If the image bearing member 1 is rotated without rotation of the electroconductive brush roller 2-B, a large amount of the developer T may be carried to the contact portion C between the image bearing member 1 and brush roller 2-B, and the developer may enter the contact portion C of the brush roller 2-B. The developer is not easily separated from the inside of the brush, and no electroconductive particle as are supplied from the outside, and therefore, the resistance of the brush roller only at such a position continues to be high even if the brush roller rotates. This would result in the non-uniform charging and therefore non-uniform image.

SUMMARY OF THE INVENTION

Accordingly, it is a principal object of the present invention to provide an image forming apparatus in which even if rotation of an image bearing member starts when a relatively large amount of a developer is present on the image bearing member or when the rotation stops, the non-uniform electric charging of the image bearing member attributable to the local deposition of the developer or the like on the charging member can be prevented.

It is another object of the present invention to provide an image forming apparatus in which passage of a large amount of the developer into a contact portion between an image bearing member and a charging member. It is a further object of the present invention to provide an image forming apparatus in which an image pattern of an image formation process appears in the next image formation.

It is a further object of the present invention to provide an image forming apparatus suitable for a cleanerless type in which the image forming apparatus is not provided with a cleaner exclusively for the cleaning of the image bearing member.

It is a further object of the present invention to provide an image forming apparatus in which an image bearing member is electrically charged using electroconductive particles at a contact portion between the image bearing member and a charging member, wherein the non-uniform electric charging of the image bearing member attributable to the local deposition of the developer or the like on the charging member can be prevented.

It is a further object of the present invention to provide an image forming apparatus in which local embedding of the developer into the surface or the charging member and the resultant deterioration of the uniformity in electrical charging.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with accompanying drawings. Embodiment 1 and Embodiment 2 are directed to the sequences for starting rotation of the image bearing member.

(Embodiment 1)

Figure 1:
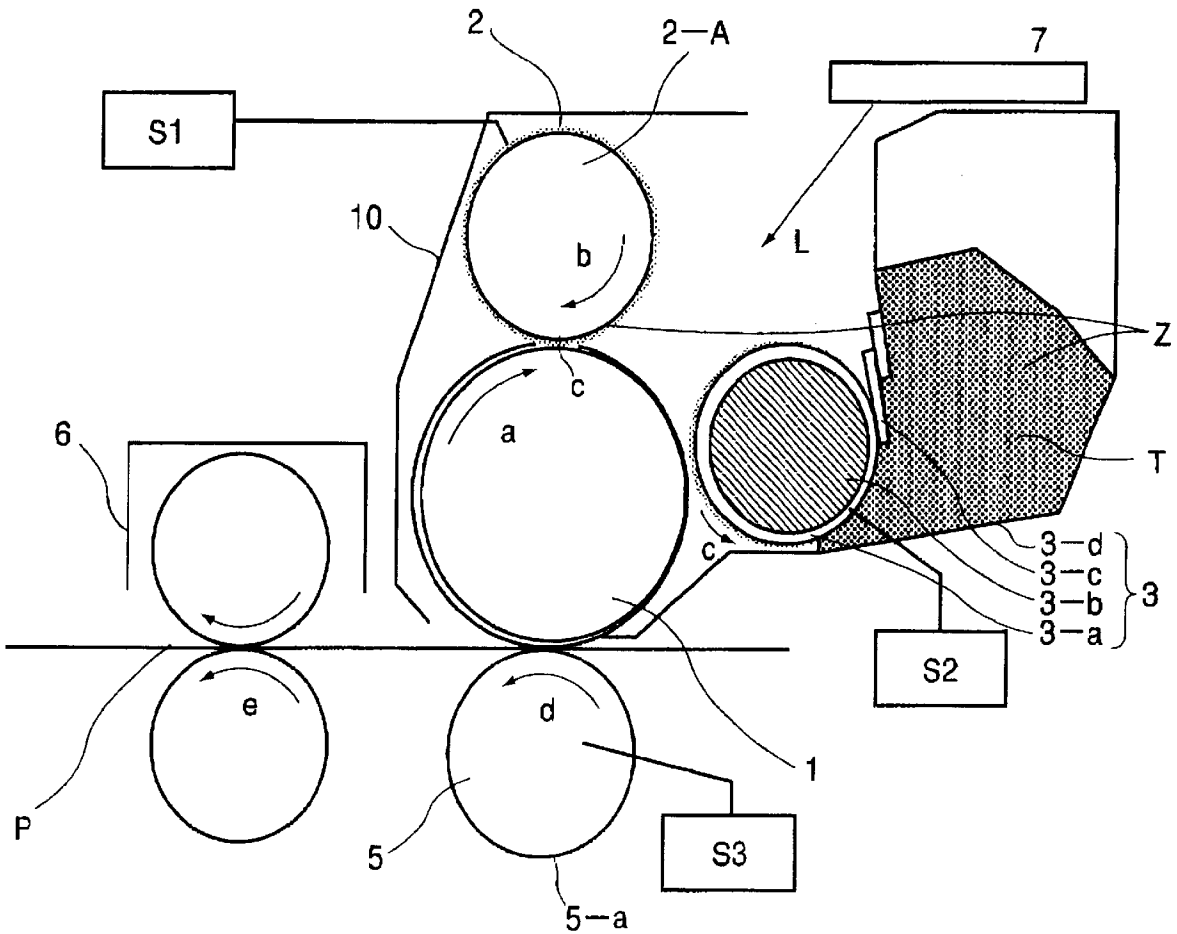
FIG. 1 is a schematic general arrangement of an image forming apparatus according to Embodiment 1 and Embodiment 3.
Figure 7:
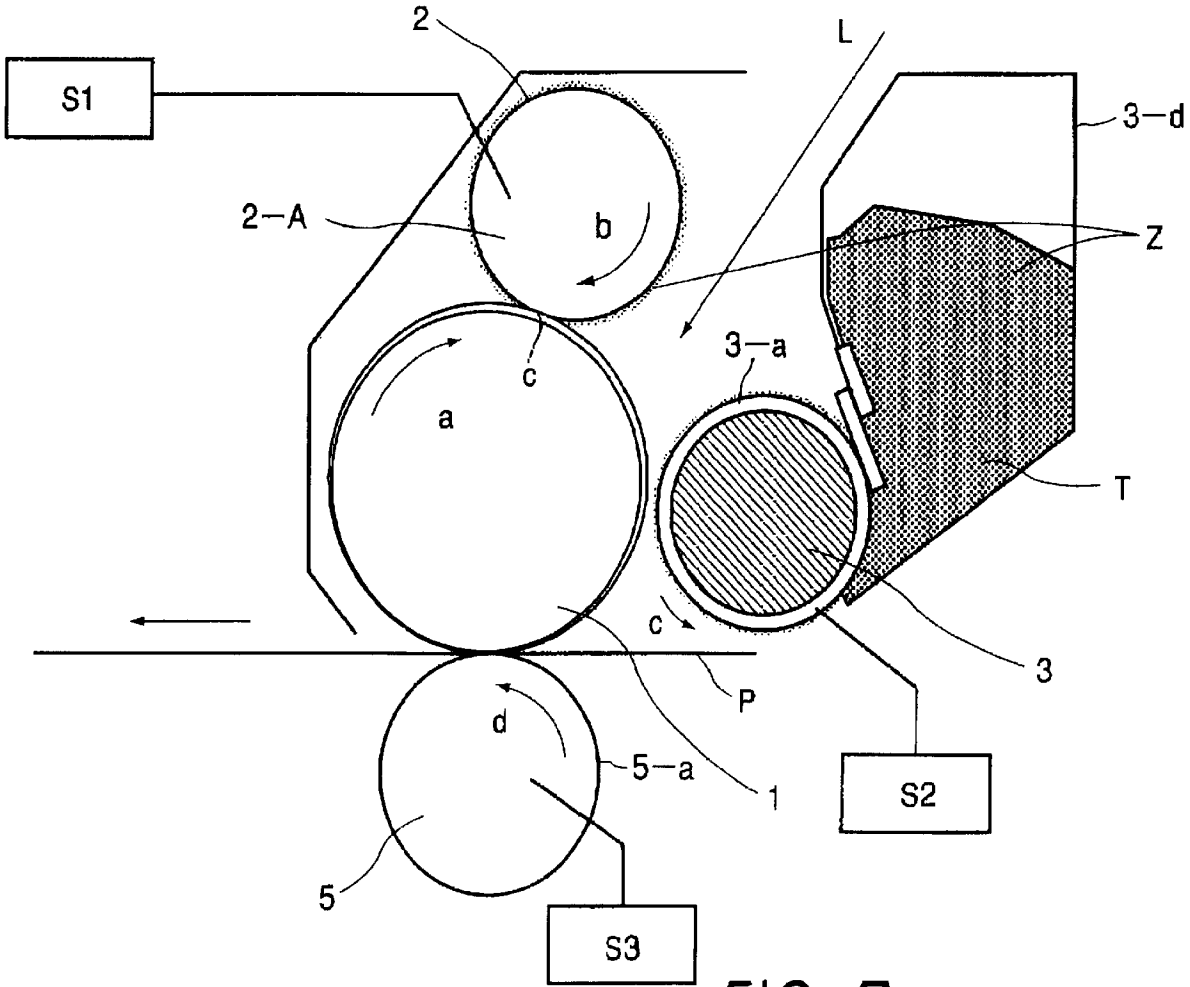
FIG. 7 is a schematic general arrangement, an example of an image forming apparatus using an injection charging and cleanerless process type.
Figure 8:
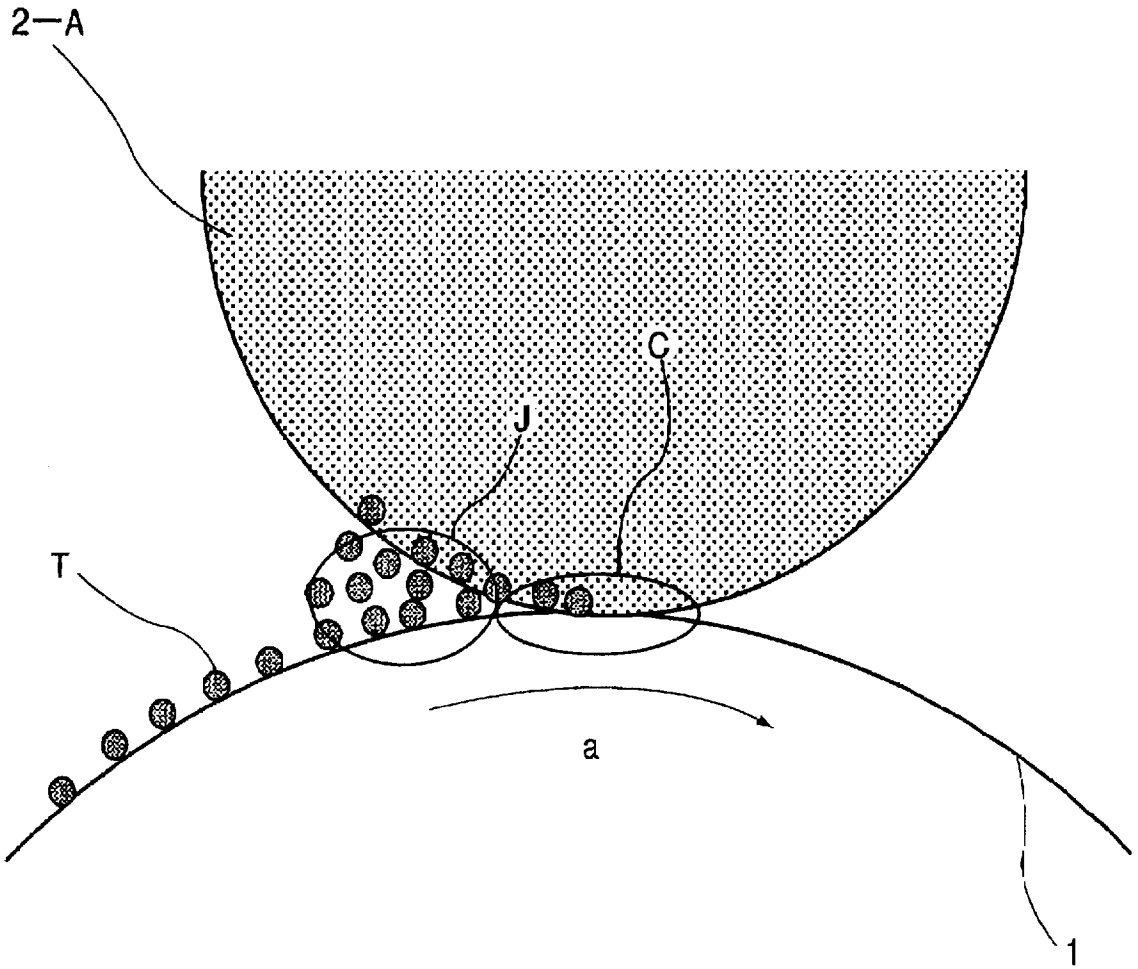
FIG. 8 is an illustration (1) of behavior of a residual developer carried to a contact portion between the image bearing member and the charging member.
Figure 9:
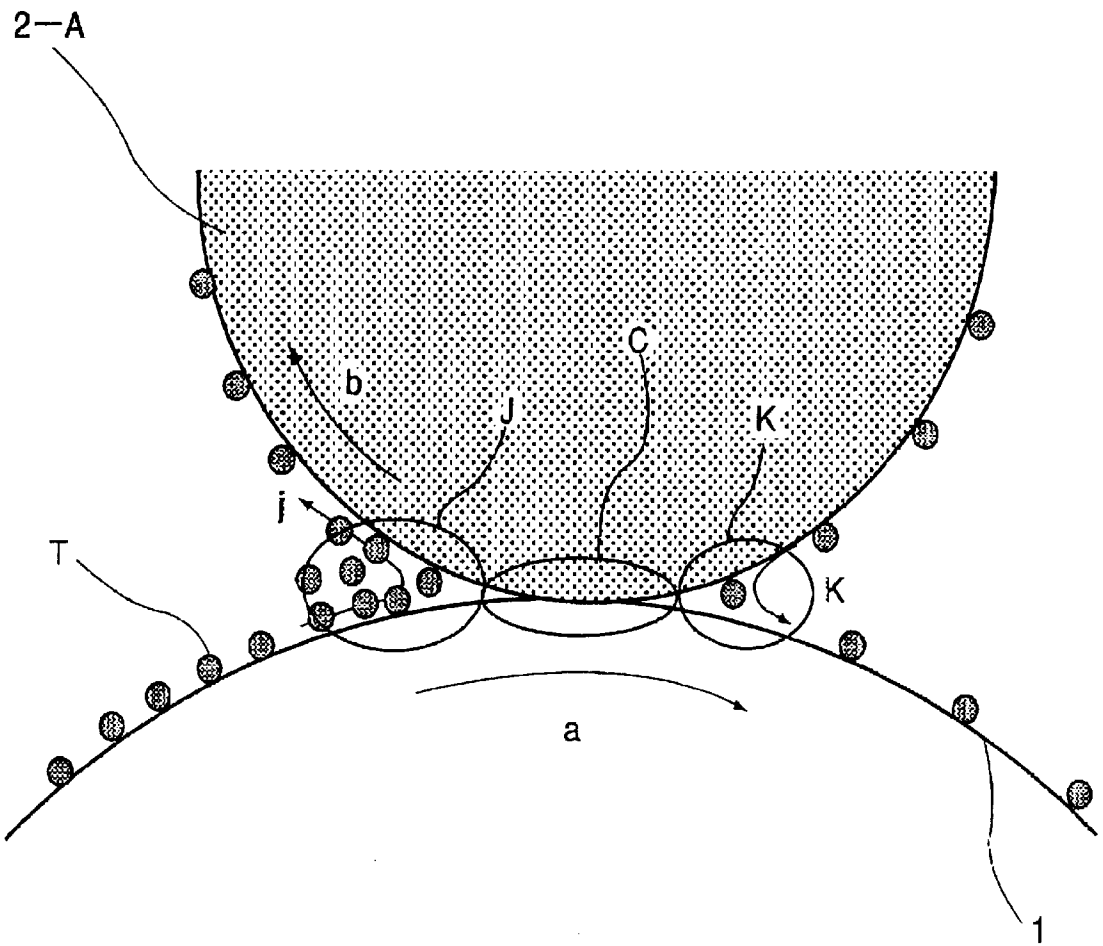
FIG. 9 is an illustration (2) of behavior of a residual developer carried to a contact portion between the image bearing member and the charging member.
Figure 10:
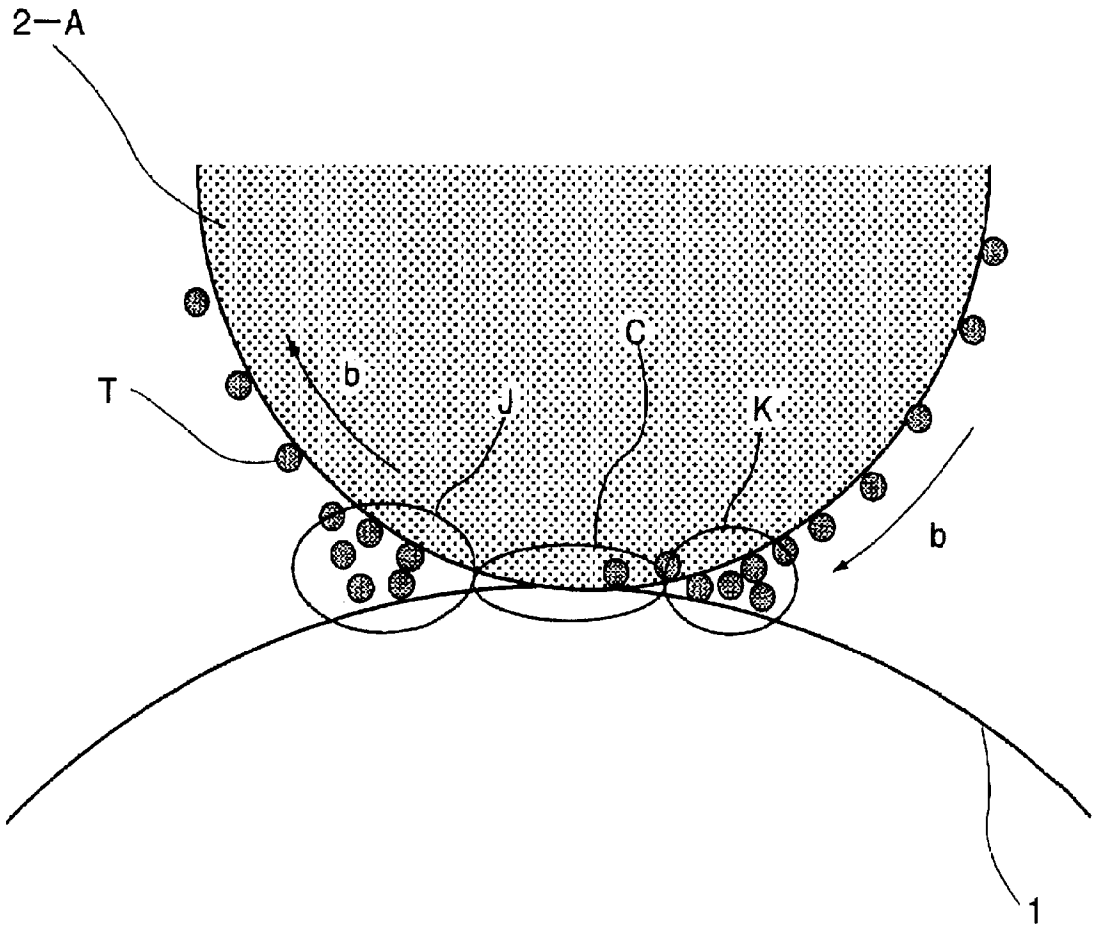
FIG. 10 is an illustration (3) of behavior of a residual developer carried to a contact portion between the image bearing member and the charging member.
Figure 11:
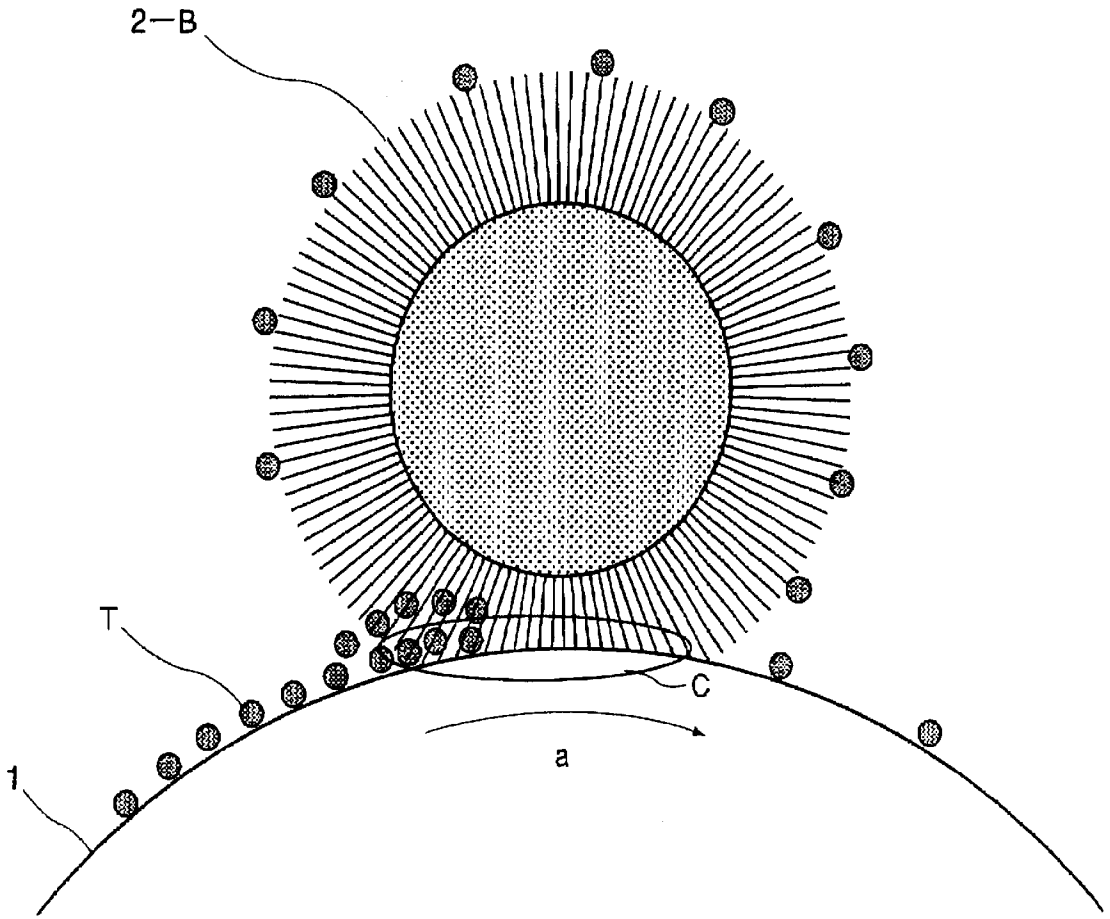
FIG. 11 is an illustration (4) of behavior of a residual developer carried to a contact portion between the image bearing member and the charging member.
Figure 12:
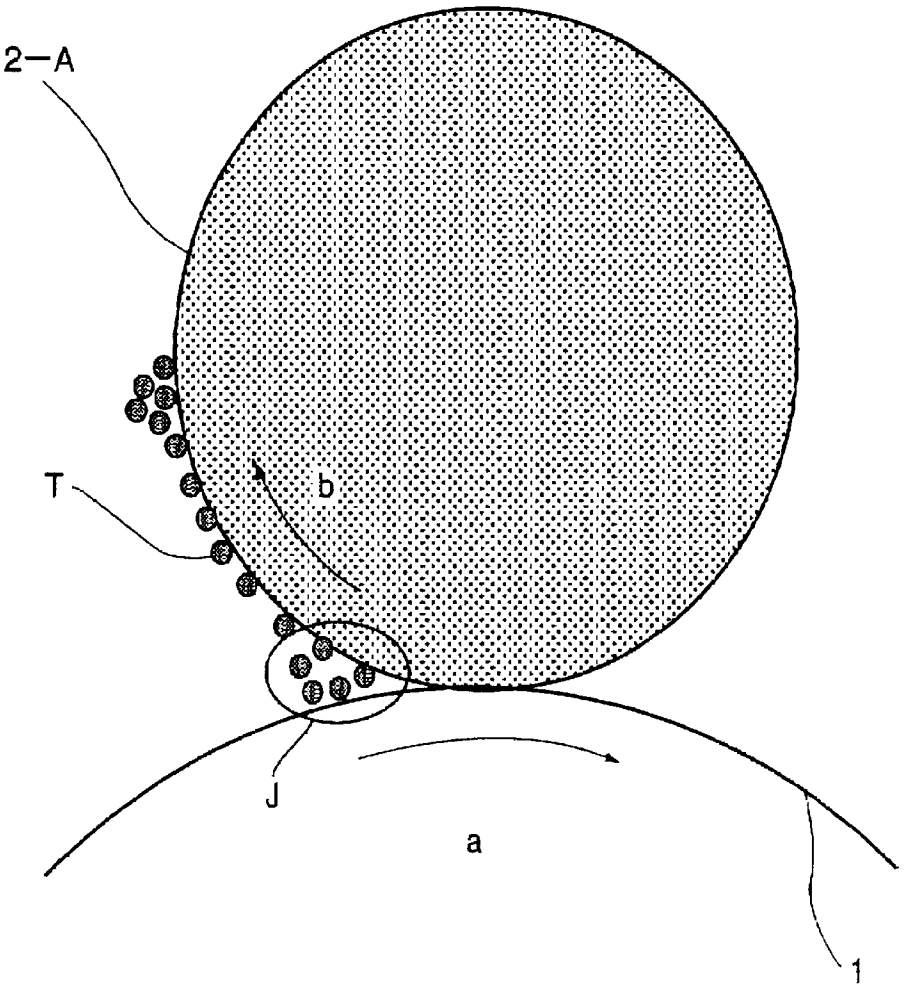
FIG. 12 is an illustration (5) of behavior of a residual developer carried to a contact portion is between the image bearing member and the charging member.
Figure 13:
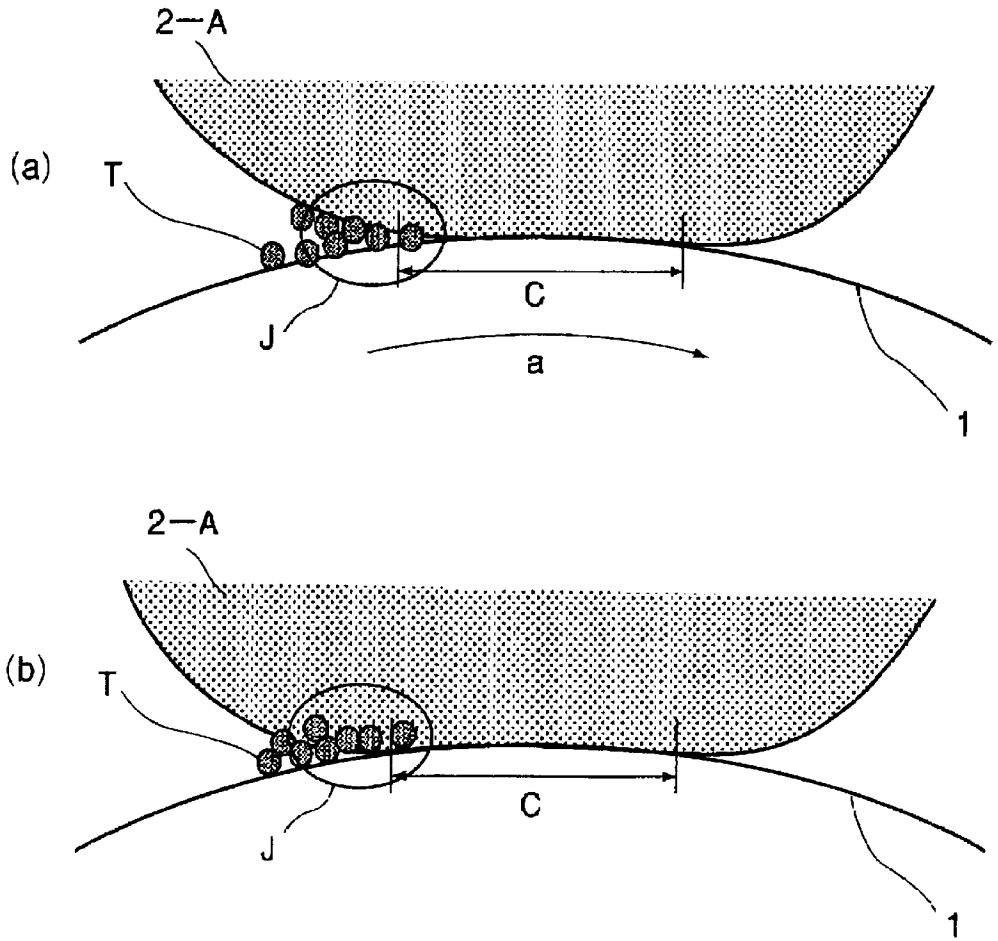
FIG. 13 is an illustration (6) of behavior of a residual developer carried to a contact portion between the image bearing member and the charging member.

FIG. 1 is a schematic sectional view of an image forming apparatus according to the embodiments of the present invention. Similarly to the image forming apparatus shown in FIG. 7, the charging means for electrically charging the image bearing member 1 is an injection charging device 2 using electroconductive particles Z, and the image forming apparatus is a cleaner-less system transfer type electrophotographic apparatus.

More particularly, it comprises the image bearing member 1, the injection charging device 2, a developing device 3 accommodating a mixture of a developer T and the electroconductive particle Z, a transferring device 5, a fixing device 6, an exposure device 7 and so on. The image bearing member 1, the injection charging device 2 and the developing device 3 are unified into a process cartridge 10, which is detachably mountable to the main assembly of the image forming apparatus which includes the transferring device 5, the fixing device 6 and the exposure device 7.

An image (developed image) is formed on the image bearing member 1 through a latent image step and a developing process, and is transferred onto a transfer sheet P (recording material) which is fed by a rotation, in the direction d, of the transfer roller 5-*a* of the transferring device 5 toward the fixing device 6, and image on the transfer sheet is fixing TV on the transfer sheet P by the fixing device 6. The transfer sheet P now having the fixed image is discharged in a rotational direction e of the fixing device 6. The charging step for the image bearing member 1 during the latent image step is carried out using the injection charging device 2 comprising a charging sponge roller 2-A coated with electroconductive particles Z. The charging sponge roller 2-A comprises an electroconductive roller having a hardness of 30°, an average pore diameter of 50 $\mu$m, and is contacted to the image bearing member 1 and rotated in such a direction that peripheral moving direction of the charging roller 2-A is opposite (arrow b) the peripheral moving direction of the image bearing member (arrow a) at a contact portion (nip) C between the image bearing member 1 and the charging roller 2-A. The surface speed thereof is the same as that of the image bearing member 1 during the image formation, that is, the relative peripheral speed relative to the surface of the image bearing member 1 is 200%.

The electroconductive particles Z are electroconductive zinc oxide particles have an average particle size of 3 μm, a resistivity of $10^6$ Ω.cm including the secondary aggregate.

The charging polarity of the electroconductive particle Z is positive which is opposite the regular charging polarity of the developer T (negative).

The electroconductive particles Z are mainly deposited in the pore portions of the sponge and covers the surface of the charging sponge roller 2-A.

Here, the charging sponge roller 2-A is supplied with a voltage of −610V relative to the image bearing member 1, from a voltage source S1. Therefore, in the region C where the image bearing member 1 and the charging sponge roller 2-A are contacted to each other, the surface potential of the image bearing member 1 tends to become the same potential as the potential −610V of the charging sponge roller 2-A, and the charge is induced to the surface of the image bearing member 1.

When the surface of the charging sponge roller 2-A is separating from the surface of the image bearing member 1, the movement of the charge occurs such that charge on the image bearing member 1 decreases. However, the amount of the decrease is dependent on the resistance values of the charging sponge roller 2-A and the electroconductive particle, the resistance value of the image bearing member 1 and the layer structure. In this embodiment, the amount of the decrease is made as small as possible by proper selections in this embodiment, more particularly, it is 10V, so that resultant surface potential of the image bearing member is −600V.

After the charging step, the light L directed from the exposure device 7 in accordance with the image information is incident on the surface of the image bearing member 1. The potential of the portions eliminated by the light lowers similarly to the electrophotographic process, so that potential difference is produced between the portions exposed to the light and portions not exposed to the light, by which an electrostatic latent image is formed.

In this embodiment, a light potential Vl which is the potential of the portion exposed to the light is Vl=−150V, while a dark potential which is the potential of the portion not exposed to the light remains Vd=−600V.

The electrostatic latent image formed on the image bearing member 1 through the latent image step is developed with the developer T by the developing device 3 through a so-called jumping developing method in which the member carrying the developer T is not contacted to the image bearing member 1.

The developing device 3 comprises a developing sleeve 3-*a* which is a rotatable developer carrying member enclosing a stationary developing magnet 3-*b*, a developing blade 3-*c* contacted to the outer surface of the developing sleeve 3-*a*, they developing container 3-*d* accommodating the developer T. The developing container 3-*d* contains the developer T and the electroconductive particles Z with a weight ratio of 1:1.5. Without a strong electric force, the most of the electroconductive particles Z move while being deposited on the developer T.

The surface of the developing sleeve 3-*a* is roughened, and carries, in a direction indicated by an arrow c, the developer T which is magnetic toner in cooperation with the magnetic force of the developing magnet 3-*b*. When the developer T passes through the contact portion relative to the developing blade 3-*c*, the thickness of the layer of the developer on the developing sleeve 3-*a* is regulated, and the developer is triboelectrically charged. The charging polarity of the developer T is determined by the material thereof, and is mainly negative in this embodiment. Simultaneously, the electroconductive particles Z passing through the region is electrically charged to the positive polarity.

Here, referring to FIG. 2, the description will be made as to the behavior of the charged developer T and electroconductive particles Z between the developing sleeve 3-*a* and the image bearing member 1.

When the developer T charged to the negative polarity reaches the region close to the image bearing member 1, it develops the electrostatic latent image by the electric field formed between the image bearing member 1 and developing sleeve 3-*a*. In this embodiment, the developing sleeve 3-*a* is supplied from a voltage source S2 with a voltage which is in the form of a DC voltage of −400V relative to the image bearing member 1 biased with an AC voltage which is a rectangular wave voltage having a frequency of 1500 Hz and a peak-to-peak voltage of 1600 vpp, so that in the gap of 300 μm formed between the image bearing member 1 and the developing sleeve 3-*a*, the developer T charged to the negative polarity does not jump to the dark portion potential portion where Vd=−600V, but jumps to the light portion potential portion where Vl=−150V.

The electroconductive particles Z charged to the positive polarity tend to jump to the dark portion potential electrically, contrary to the developer T, but because of the sizes thereof, many of them are deposited on the developer T per se. When the electrostatic force between the developer T is stronger, there are electroconductive particles Z which move in the same manner as the developer T, that is, not behave contrarily relative to the developer T. Therefore, the electroconductive particles Z are capable of jumping to the light portion potential portions and to the dark portion potential portions.

The developer T having moved to the image bearing member 1 in the developing process is transferred onto the transfer material P in the transfer step. The transfer roller 5-*a* of the transferring device 5 is supplied, from a voltage source S3, with a DC voltage of +2 KV relative to the image bearing member 1 such that electric field is formed between the image bearing member 1 and transfer roller 5-*a*. Because of the electric field, the developer T which is charged to the negative polarity is attracted to the transfer roller 5-*a*, and therefore, most of the is transferred onto the transfer sheet P.

On the other hand, as to the electroconductive particles Z charged to the positive polarity, most of the electroconductive particles Z deposited on the developer T are transferred onto the transfer sheet P together with the developer T, but from the electrical standpoint, they are stabilized when they are on the image bearing member 1, and therefore, many of them remain on the image bearing member 1, as compared with the developer T. Most of the electroconductive particles Z deposited on the dark potential portions remain on the image bearing member 1.

Accordingly, on the image bearing member 1 after the transfer step, there exist the small amount of the developer T in the light portion potential having remained despite the transfer step and a relatively large amount of the electroconductive particles Z remaining over the whole surface of the image bearing member 1.

Since the means forming apparatus is not provided with a cleaner exclusively for the cleaning of the image bearing member, the developer T and the electroconductive particle Z supplied to the image bearing member 1 reach the charging sponge roller 2-A. As described hereinbefore in conjunction with the prior art, the developer T is transferred onto the charging sponge roller 2-A in a relatively early stage, and thereafter, they return to the image bearing member 1 and are carried by the image bearing member 1. The electroconductive particle Z, however, are retained on the charging sponge roller 2-A and function for the injection charging.

As described in the foregoing with respect to a prior art example, the developer T charged to the negative polarity is mixed with the developer T for developing the next image when it passes through the developing zone where the developing sleeve 3-*a* and image bearing member 1 are close to each other. Therefore, the image formation is not influenced.

Here, in this embodiment, the drive timing of the image bearing member 1 and the charging sponge roller 2-A of the image forming apparatus are particularly noted, and the image bearing member 1 and the charging sponge roller 2-A are always rotated at the same time.

Therefore, when the process cartridge 10 is mounted to the image forming apparatus, a pre-process step is carried out for the purpose of detecting the mounting of the process cartridge 10, and then a series of the image forming operations is started in response to an image formation signal supplied to the image forming apparatus. In the pre-process step, and at the start of the series of the image forming operations, the rotation of the charging sponge roller 2-A is started simultaneously with the rotation of the image bearing member 1.

The series of image forming process operations (1) with the rotation of the image bearing member 1 in image forming apparatus of this embodiment includes a pre-rotation step (1) in which pre-process operations including a temperature control for the fixing device 6, a voltage control for the transferring device 5 and so on, an image forming process step (2) executing the image forming operations, a post-rotation step (3) in which on the image bearing member 1 and/or the transfer roller 5-*a* are cleaned. After the completion of the post-rotation step (3), the rotation of the image bearing member 1 stops.

Figure 3:
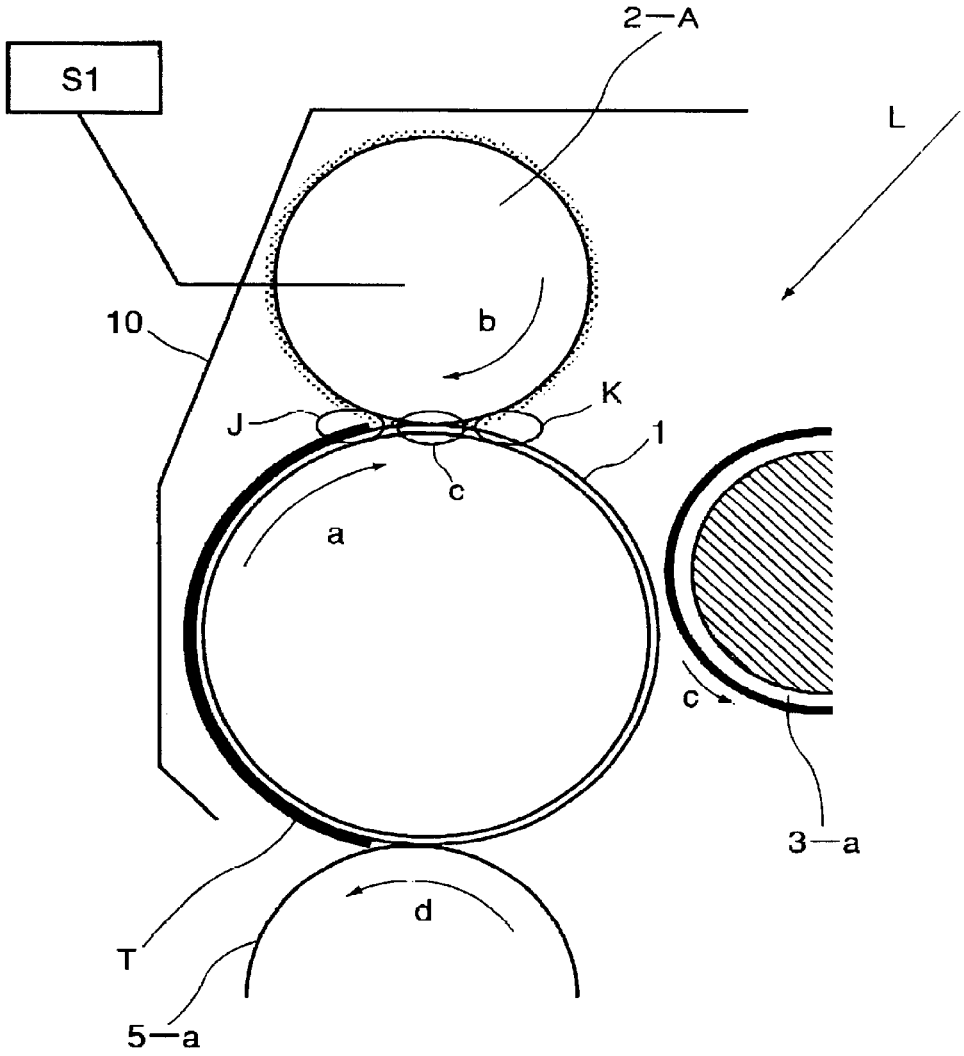
FIG. 3 is a partial enlarged view of an image forming apparatus.

As described in the foregoing, when a relatively large amount of the developer T remains after the image transfer operation in the image forming process (2), a relatively large amount of the developer T is present on the image bearing member 1 from the charging sponge roller 2-A to the position close to the developing sleeve 3-*a* and at the inlet J portion of the contact portion C between the image bearing member 1 and charging sponge roller 2-A shown in FIG. 3, although most of the remaining developer T is removed from the image bearing member 1 in the post-rotation step (3). In such a state, a large amount of the developer T is deposited on the transfer roller 5-*a* in many cases, and a large amount of the developer T is discharged onto the image bearing member 1 by the cleaning process for the transfer roller 5-*a* during the post-rotation step (3), but is not completely collected in the developing process. In such a case, the same problem arises.

On the contrary, when a large number of whity images or the like are continuously formed, a relatively large amount of the electroconductive particles Z may be present on the entire surface of the image bearing member 1 including the J portion.

If the image bearing member 1 continues to rotate before the charging sponge roller 2-A starts to rotate with this state, the above-described image defect relatively easily occurs. However, in this embodiment, the image bearing member 1 and the charging sponge roller 2-A start to rotate simultaneously, it can be avoided that said developer T and the electroconductive particle Z and is are concentrated at a particular position or that said electroconductive particles Z are embedded into the charging sponge roller 2-A. Therefore, the above-described problems can be avoided.

In the case that emergency stop of the main assembly of the image forming apparatus occurs due to jam or the like of the transfer sheet P, and the pre-rotation step (1) has to be carried out with a large amount of the developer T remaining on the image bearing member 1, the continuous rotation of the image bearing member 1 before the start of rotation of the charging sponge roller 2-A results in the similar problems. However, in this embodiment, there is no such problems.

In this embodiment, the rotation of the image bearing member 1 and the rotation of the charging sponge roller 2-A start simultaneously with each other. However, in order to solve the problems, what is required is that rotation of the image bearing member 1 is not prior to the start of the rotation of the charging sponge roller 2-A. Therefore, it is not inevitable to rotate the charging roller and the image bearing member simultaneously, but the problems can be avoided if the charging sponge roller 2-A starts to rotate prior to start of rotation of the image bearing member 1.

On the other hand, the continuous rotation of the charging sponge roller 2-A with the image bearing member 1 at rest, may leads to a problem. This arises in the case that large amount of the developer T is present at the J portion before the start of rotation of the charging sponge roller 2-A. Normally, the amount of the developer existing at the J portion is not so large, and the amount of the developer entering the contact portion C between the image bearing member 1 and the charging sponge roller 2-A is not so large unless only the charging sponge roller 2-A continues to rotate for a long term. However, depending on the state of use of the image forming apparatus, the above-described problems may arise. This may be the case, for example, when a large amount of the developer T is accumulated on the charging sponge roller 2-A or when the charging power is not abundant enough (less margin) due to high resistance of the charging sponge roller 2-A per se as in the case of deterioration or the like.

In view of this, in order to avoid the above-described problems with certainty, it is preferable that image bearing member starts to rotate before the developer T existing at the J portion at the time of the start of rotation of the charging sponge roller 2-A moves to the K portion which is before the contact portion C between the image bearing member 1 and the charging sponge roller 2-A, namely that said image bearing member 1 starts to rotate before the initial one full-turn of the charging sponge roller 2-A.

In this embodiment, the image bearing member 1 and the charging sponge roller 2-A are driven from a single driving system through gears in order to accomplish the simultaneous stopover rotation. However, independent driving systems may be used in order to satisfy the above-described condition for the starts of rotations.

In this embodiment, the rotation of the charging sponge roller 2-A starts simultaneously with start of rotation of the image bearing member 1, by which the problems of the improper charging due to the deposition of the large amount of the developer T on the charging sponge roller 2-A can be avoided.

In addition, this embodiment is effective also to avoid the problem that developer T or the electroconductive particles Z are excessively supplied to a predetermined position on the charging sponge roller 2-A, and therefore, non-uniformity of the resistance value on the charging sponge roller 2-A arises with the result of non-uniform charging power.

Also, in this embodiment, when the image forming apparatus is resumed after a temporary stop due to the occurrence of the sheet jam or the like, the removal of the developer T and the electroconductive particle Z on the image bearing member 1 in the previous process is minimized, and therefore, the time required for the post-rotation step (3) can be minimized.

These advantageous effects are provided by starting to rotate the charging sponge roller 2-A simultaneously with or prior to start of rotation of the image bearing member 1.

Additionally, by preventing continuous rotation of the charging sponge roller 2-A while the image bearing member 1 is at rest, the problem of occurrence of improper charging attributable to high resistance of the contact portion C between the image bearing member 1 and the charging sponge roller 2-A by the developer T, can be suppressed.

(Embodiment 2)

Figure 4:
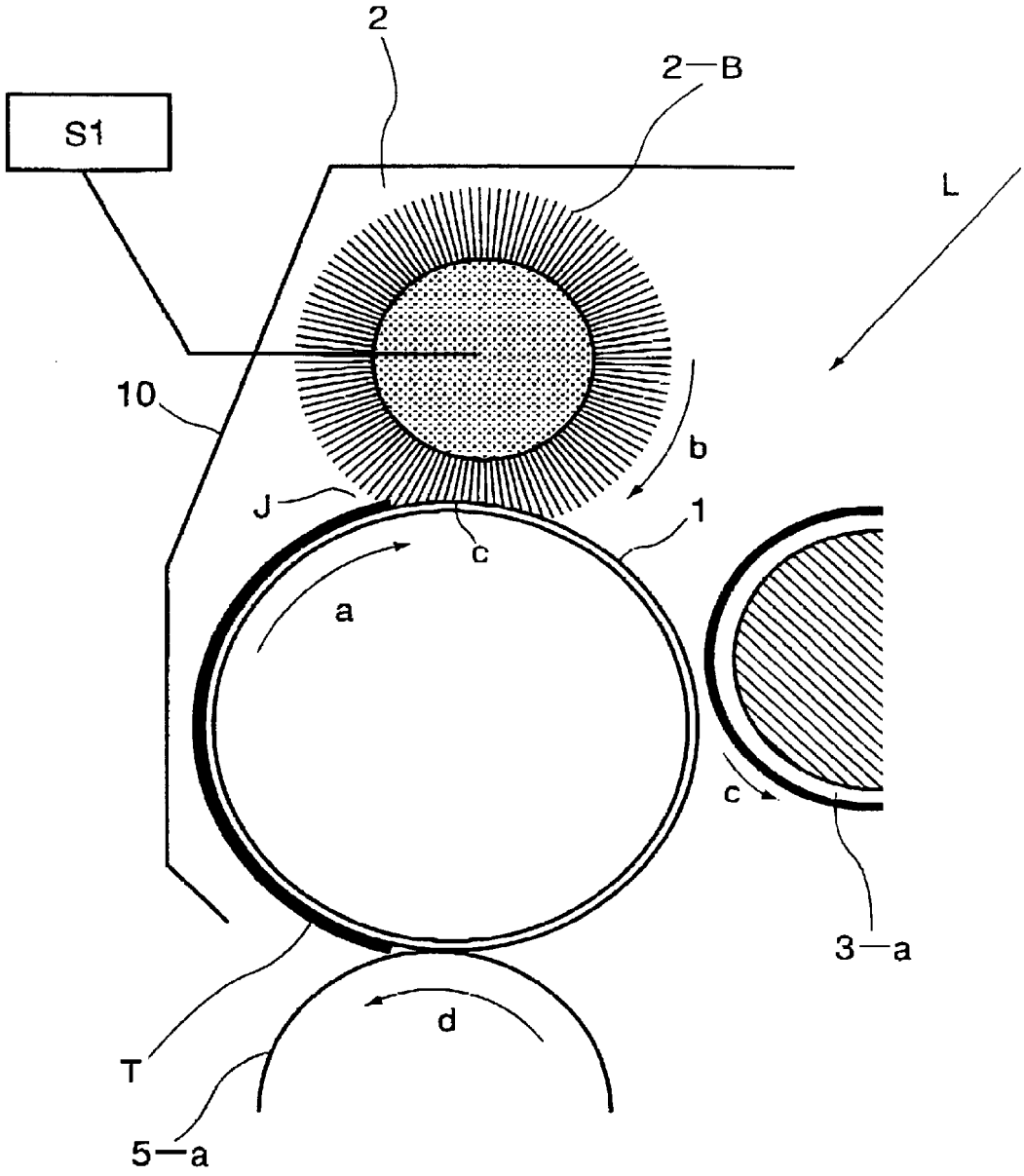
FIG. 4 is a schematic general arrangement of an image forming apparatus according to Embodiment 2 and Embodiment 4.
Figure 5:
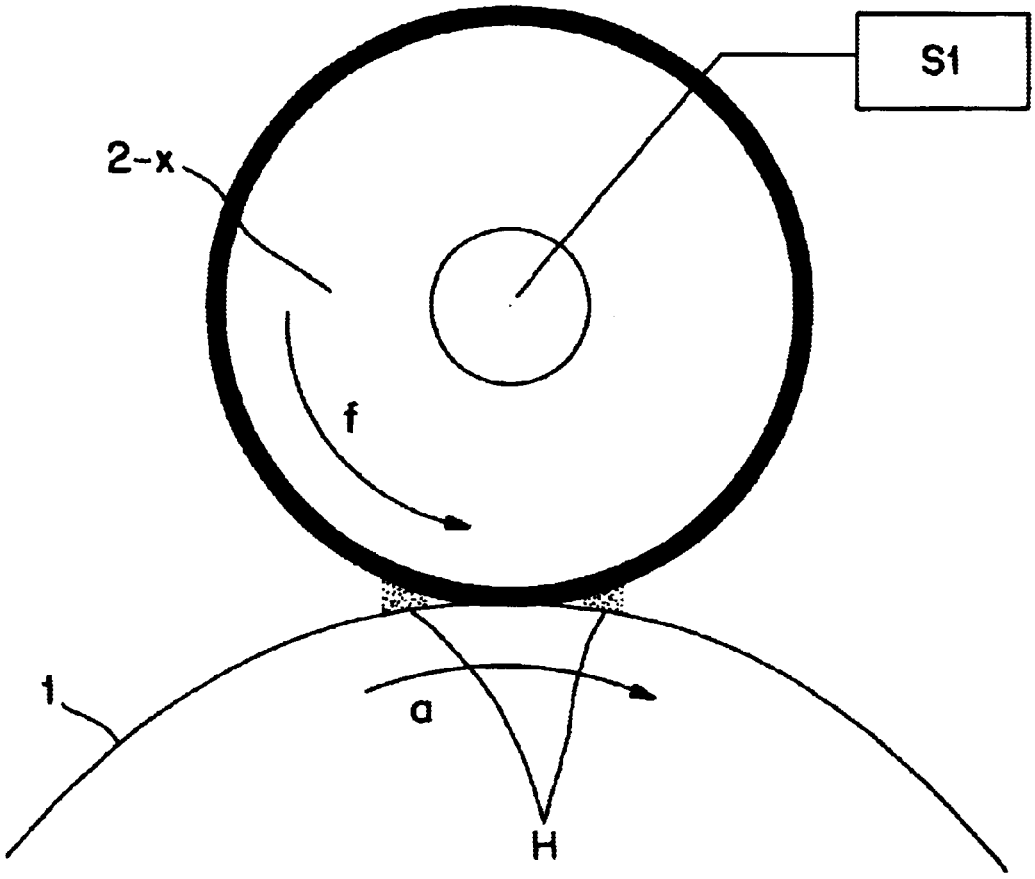
FIG. 5 PRIOR ART
FIG. 5 is an illustration of a roller charging.
Figure 6:
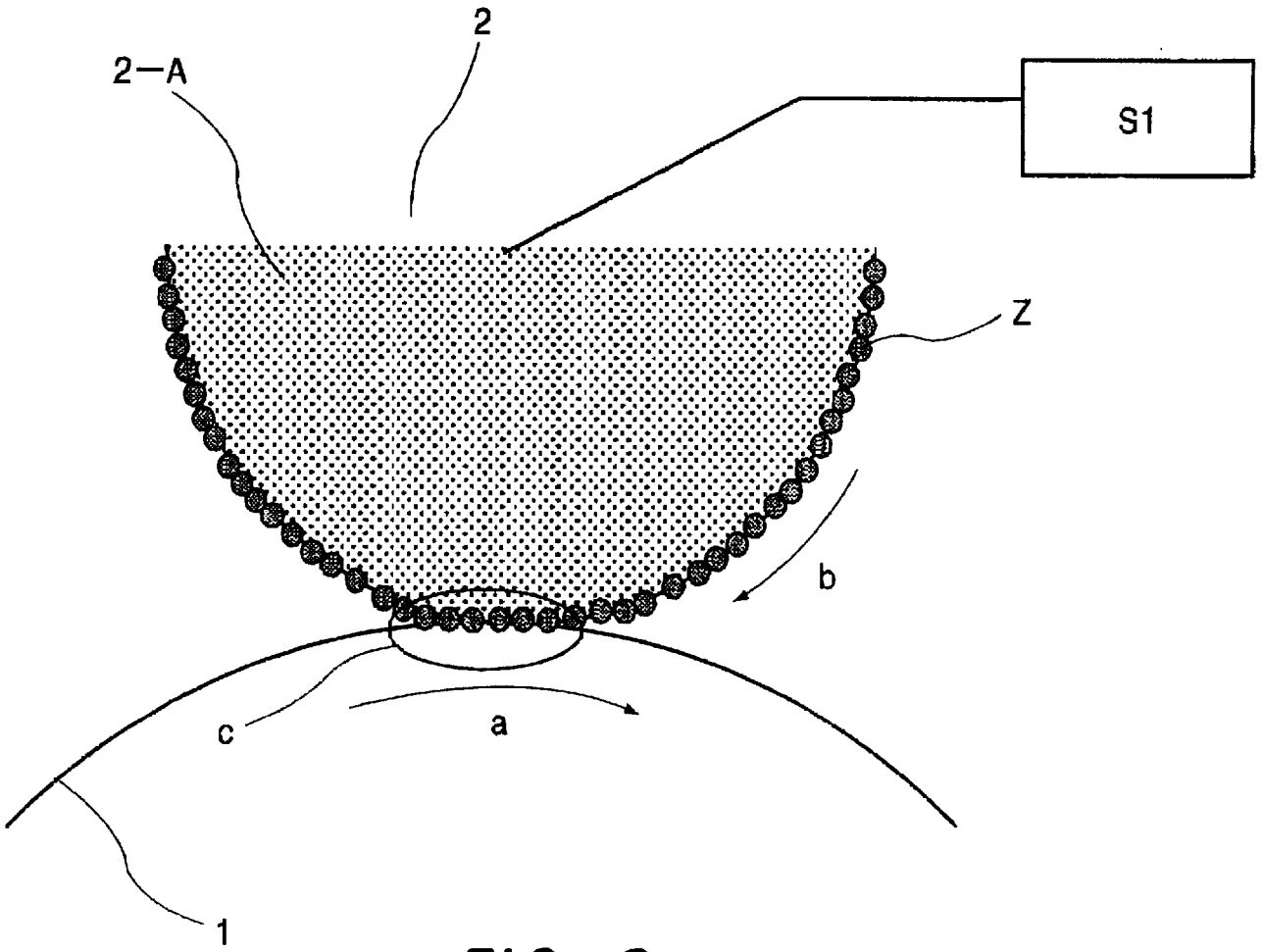
FIG. 6 is an illustration of injection charging using electroconductive particles.

FIG. 4 is a schematic sectional view of an image forming apparatus according to second embodiment of the present invention, in which the charging device 2 is a brush charger which is rotated for the counterdirectional peripheral movement relative to the image bearing member 1. The structures of image forming apparatus in this embodiment is similar to those of first embodiment except for the charging device 2.

The brush roller 2-B in this embodiment comprises a base roller and a large number of low resistance brush fibers planted thereon.

The brush roller 2-B is supplied with a DC voltage of −610V relative to the image bearing member 1 from a voltage source S1, and the brush fibers constitute injection sites in the injection charging system. The injection of the portions of the image bearing member contacted by the brush fibers tend to become the same potential as the brush fibers, so that said image bearing member 1 is charged to −600V similarly to the first embodiment.

The brush roller 2-B is rotated such that peripheral movement of the brush roller 2-B is counterdirectional as indicated by an arrow b relative to the rotational direction an of the image bearing member 1, while being in contact with the image bearing member 1. The surface speed per se is the same as that of the image bearing member 1 during the image forming operation, that is, the surface speed of the brush roller 2-B is 200% relative to the surface speed of the image bearing member 1.

The counterdirectional rotation is employed in order to increase the number of contacts of the fibers of the brush to the image bearing member 1 per unit time to enhance the uniformity of the charging. In addition, similarly to the system of first embodiment, the developer T remaining on the image bearing member 1 after the transfer step is dissipated to avoid the influence to the next image formation.

In this embodiment, the image bearing member 1 and the brush roller 2-B are always rotated simultaneously. Therefore, when the process cartridge 10 is mounted to the image forming apparatus, a pre-process step is carried out for the purpose of detecting the mounting of the process cartridge 10, and then a series of image forming operations is started in response to an image formation signal supplied to the image forming apparatus. In the pre-process step, and at the start of the series of the image forming operations, the rotation of the brush roller 2-B is started simultaneously with the rotation of the image bearing member 1.

In image forming apparatuses using brush roller, the problems underlying the present invention are fundamentally the same as those with the first embodiment. The mechanism or the arising of the problems, however, is a little different.

In the case of the brush roller 2-B, the pressure of contact to the image bearing member 1 is not as high as with the charging sponge roller 2-A, and therefore, the amount of the developer T stagnating at the inlet portion J portion of the contact portion C between the image bearing member 1 and the brush roller 2-B is smaller than in the case of charging sponge roller 2-A. However, at the J portion on the brush roller 2-B, the developer T gradually enter the brush with the result of rising the resistance. In this embodiment, there is provided no means for improving the charging power from the outside as in the first embodiment. It is difficult to recover the charging power of the portion if the developer T is removed from the brush.

The developer T having passed through the contact portion C between the image bearing member 1 and the brush roller 2-B is charged to the positive polarity if the developer T is the residual toner remaining after the image transfer, and therefore, collection is difficult. In addition, since the amount of the developer T not transferred after occurrence of the jam is large, a large amount of the developer T reaches the transfer roller 5-*a* and is deposited onto the transfer roller 5-*a* to deteriorate the image quality.

In this embodiment, similarly to the first embodiment, the brush roller 2-B (charging member) is rotated simultaneously with stop of rotation of the image bearing member 1, and therefore, the above-described problems do not arise, and satisfactory charging power is always assured.

In this embodiment, the same advantageous effects are provided if the brush roller 2-B is rotated earlier than the image bearing member 1. On the other hand, the problems with first embodiment when the charging member continues to rotate prior to the start of rotation of the image bearing member do not easily arise in this embodiment.

In this embodiment, the occurrence of non-uniformity in the charging attributable to the local deposition of the developer T in the case of use of the brush roller 2-B can be avoided.

Embodiments 3 and 4 are directed to a sequence of stop of rotation of the image bearing member.

(Embodiment 3)

Figure 2:
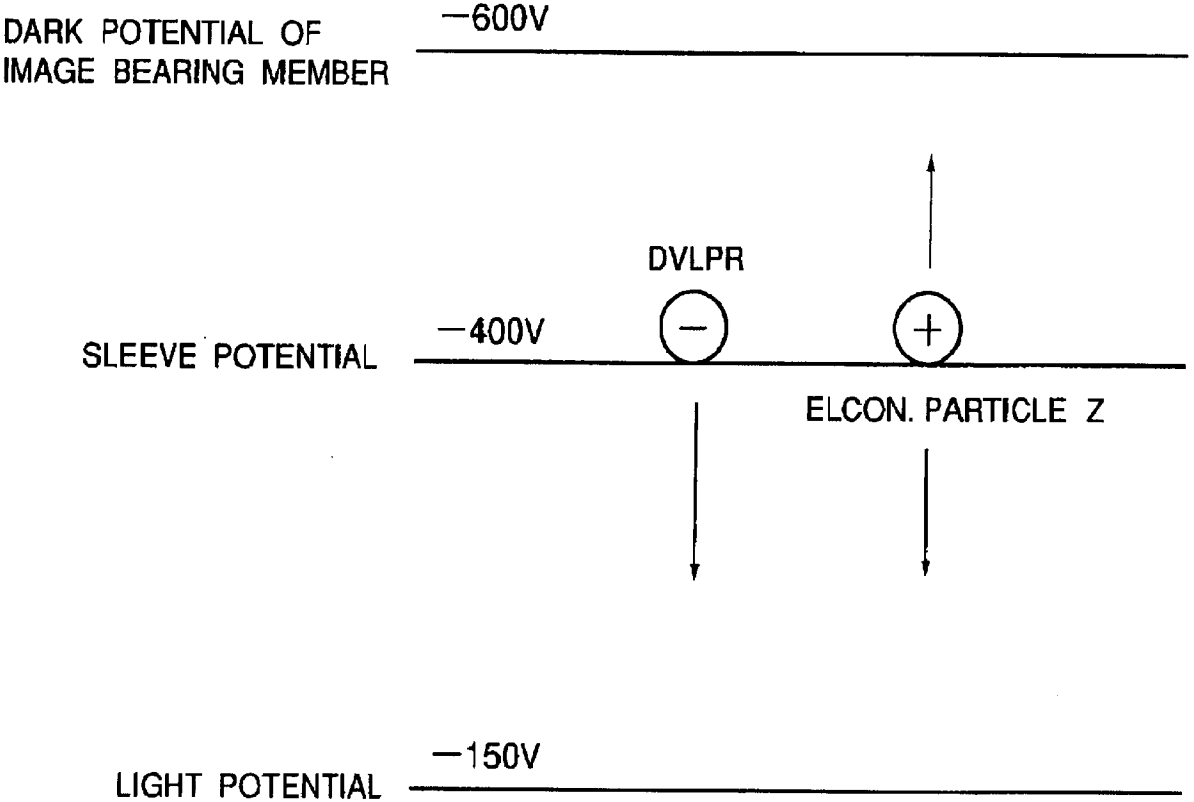
FIG. 2 is an illustration of behavior of a developer and an electroconductive particle in a developing zone.

In these embodiments, the structures of the hardware of the image forming apparatus is the same as those of the image forming apparatus shown in FIGS. 1 to 3, and therefore, the detailed description thereof is omitted for simplicity.

In this embodiment, as to the drive timing of the rotations of the image bearing member 1 and the charging sponge roller 2-A of the image forming apparatus, the rotations of the image bearing member 1 and the charging sponge roller 2-A are always simultaneously stopped.

Therefore, when the process cartridge 10 is mounted to the image forming apparatus, a pre-process step is carried out for the purpose of detecting the mounting of the process cartridge 10, and then the image forming process is started in response to an image formation signal supplied to the image forming apparatus. In the pre-process step, and at the end of the series of the image forming operations, the rotation of the charging sponge roller 2-A is stopped simultaneously with stop of the rotation of the image bearing member 1. As described hereinbefore, in an ordinary image forming apparatus, the series of image forming process operations (1) with the rotation of the image bearing member 1 in image forming apparatus of this embodiment includes a pre-rotation step (1) in which pre-process operations including a temperature control for the fixing device 6, a voltage control for the transferring device 5 and so on, an image forming process step (2) executing the image forming operations, a post-rotation step (3) in which on the image bearing member 1 and/or the transfer roller 5-*a* are cleaned. After the completion of the post-rotation step (3), the rotation of the image bearing member 1 stops.

As described in the foregoing, when a relatively large amount of the developer T remains after the image transfer operation in the image forming process (2), a relatively large amount of the developer T is present on the image bearing member 1 from the charging sponge roller 2-A to the position close to the developing sleeve 3-*a* and at the inlet J portion of the contact portion C between the image bearing member 1 and charging sponge roller 2-A shown in FIG. 3, although most of the remaining developer T is removed from the image bearing member 1 in the post-rotation step (3). In such a state, a large amount of the developer T is deposited on the transfer roller 5-*a* in many cases, and a large amount of the developer T is discharged onto the image bearing member 1 by the cleaning process for the transfer roller 5-*a* during the post-rotation step (3), but is not completely collected in the developing process. In such a case, the same problem arises.

On the contrary, when a large number of whity images or the like are continuously formed, a relatively large amount of the electroconductive particles Z may be present on the entire surface of the image bearing member 1 including the J portion. If the charging sponge roller 2-A stops before the stop of the image bearing member 1 with this state, the above-described image defect relatively easily occurs. However, in this embodiment, the image bearing member 1 and the charging sponge roller 2-A are stopped simultaneously, it can be avoided that said developer T and the electroconductive particle Z and is are concentrated at a particular position or that said electroconductive particles Z are embedded into the charging sponge roller 2-A. Therefore, the above-described problems can be avoided.

In the case that emergency stop of the main assembly of the image forming apparatus occurs due to jam or the like of the transfer sheet P, and the pre-processing step has to be carried out with a large amount of the developer T remaining on the image bearing member 1, the stop of the charging sponge roller 2-A before stop of the image bearing member 1 results in the similar problems. However, in this embodiment, there is no such problems.

In this embodiment, the stop of rotation of the image bearing member 1 and stop of the rotation of the charging sponge roller 2-A occurs simultaneously with each other. However, in order to solve the problems, what is required is that stop the charging sponge roller 2-A is not prior to the stop of the image bearing member 1. The simultaneous stop is not inevitable.

On the other hand, the continuous rotation of the charging sponge roller 2-A with the image bearing member 1 at rest, may leads to a problem. This arises in the case that large amount of the developer T is present at the J portion at this time when the image bearing member 1 stops. Normally, the amount of the developer existing at the J portion is not so large, and the amount of the developer entering the contact portion C between the image bearing member 1 and the charging sponge roller 2-A is not so large unless only the charging sponge roller 2-A continues to rotate for a long term. However, depending on the state of use of the image forming apparatus, the above-described problems may arise. This may be the case, for example, when a large amount of the developer T is accumulated on the charging sponge roller 2-A or when the charging power is not abundant enough (less margin) due to high resistance of the charging sponge roller 2-A per se as in the case of deterioration or the like.

In view of this, in order to avoid the above-described problems with certainty, it is preferable that rotation of the charging sponge roller 2-A is stopped before the developer T existing at the J portion at the time of the stop of rotation of the image bearing member 1 reaches the K portion which is before the contact portion C between the image bearing member 1 and the charging sponge roller 2-A. Namely, the rotation of the charging sponge roller 2-A is stopped before one full-turn of the charging sponge roller 2-A after the end of the rotation of the image bearing member.

In this embodiment, the image bearing member 1 and the charging sponge roller 2-A are driven from a single driving system through gears in order to accomplish the simultaneous stopover rotation. However, independent driving systems may be used in order to satisfy the above-described condition for the stops of rotations.

In this embodiment, the rotation of the charging sponge roller 2-A stops simultaneously with stop of rotation of the image bearing member 1, by which the problems of the improper charging due to the deposition of the large amount of the developer T on the charging sponge roller 2-A can be avoided.

In addition, this embodiment is effective also to avoid the problem that developer T or the electroconductive particles Z are excessively supplied to a predetermined position on the charging sponge roller 2-A, and therefore, non-uniformity of the resistance value on the charging sponge roller 2-A arises with the result of non-uniform charging power.

Even if the image forming operation is kept unused for a long term, a large amount of the developer T and/or the electroconductive particles Z are not kept in the contact portion C between the image bearing member 1 and the charging sponge roller 2-A, and therefore, they are not embedded in the charging sponge roller 2-A so that satisfactory charging power is maintained.

Also, in this embodiment, when the image forming apparatus is resumed after a temporary stop, the removal of the developer T and the electroconductive particle Z on the image bearing member 1 in the pre-rotation is minimized, and therefore, the time required for the post-rotation step (3) can be minimized.

These advantageous effects are provided by stopping rotation of the charging sponge roller 2-A simultaneously with or subsequent to the stop of rotation of the image bearing member 1.

Additionally, by preventing continuous rotation of the charging sponge roller 2-A while the image bearing member 1 is at rest, the problem of occurrence of improper charging attributable to high resistance of the contact portion C between the image bearing member 1 and the charging sponge roller 2-A by the developer T, can be suppressed.

(Embodiment 4)

In these embodiments, the structures of the hardware of the image forming apparatus is the same as those of the image forming apparatus shown in FIG. 4 (Embodiment 2) using a brush roller 2-B as the charging member, and therefore, the detailed description thereof is omitted for simplicity.

In this embodiment, the image bearing member 1 and the brush roller 2-B are always stopped simultaneously. Therefore, when the process cartridge 10 is mounted to the image forming apparatus, a pre-process step is carried out for the purpose of detecting the mounting of the process cartridge 10, and then the image forming process is started in response to an image formation signal supplied to the image forming apparatus. In the pre-process step, and at the end of the series of the image forming operations, the rotation of the said brush roller 2-B is stopped simultaneously with stop of the rotation of the image bearing member 1.

In image forming apparatuses using brush roller, the problems underlying the present invention are fundamentally the same as those with the first and third embodiments using the sponge roller. The mechanism of the arising of the problems, however, is a little different. In the case of the brush roller 2-B, the pressure of contact to the image bearing member 1 is not as high as with the charging sponge roller 2-A, and therefore, the amount of the developer T stagnating at the inlet portion J portion of the contact portion C between the image bearing member 1 and the brush roller 2-B is smaller than in the case of charging sponge roller 2-A. In this embodiment, there is provided no means for improving the charging power from the outside as in the third embodiment. It is difficult to recover the charging power of the portion if the developer T is removed from the brush.

The developer T having passed through the contact portion C between the image bearing member 1 and the brush roller 2-B is charged to the positive polarity if the developer T is the residual toner remaining after the image transfer, and therefore, collection is difficult. In addition, since the amount of the developer T not transferred after occurrence of the jam is large, a large amount of the developer T reaches the transfer roller 5-*a* and is deposited onto the transfer roller 5-*a* to deteriorate the image quality.

In this embodiment, similarly to the third embodiment, the brush roller 2-B (charging member) is stopped simultaneously with stop of rotation of the image bearing member 1, and therefore, the above-described problems do not arise, and satisfactory charging power is always assured.

In this embodiment, the same advantageous effects are provided if the brush roller 2-B is stopped later than the image bearing member 1. On the other hand, the problems with the third embodiment when the charging member continues to rotate prior to the start of rotation of the image bearing member do not easily arise in this embodiment.

In this embodiment, the occurrence of non-uniformity in the charging attributable to the local deposition of the developer T in the case of use of the brush roller 2-B can be avoided.

(Others)

1) it is advantageous to properly combine the structures of Embodiments 1–4.
2) the contact charging member is not limited to the structures used in the foregoing embodiments.
3) the charging bias to be applied to the contact charging member or the developing bias to be applied to the developing member may be in the form of a DC voltage biased with an alternating voltage (AC voltage).

The waveform of the alternating voltage is optional; the alternating wave may be in the form of a sine wave, a rectangular wave, a triangular wave, or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

4) The choice of the means for exposing the surface of an image bearing member to form an electrostatic latent image does not need to be limited to the laser based digital exposing means described in the preceding embodiments. It may be an ordinary analog exposing means, a light emitting element such as a LED, or a combination of a light emitting element such as a fluorescent light and a liquid crystal shutter. In other words, it does not matter as long as it can form an electrostatic latent image correspondent to the optical information of a target image.

The image bearing member may be an electrostatic recording dielectric member or the like. In such a case, the dielectric member surface is uniformly charged (primary charging) to a predetermined polarity and potential, and thereafter, the selective discharging is effected by discharging needle head, electron gun or another discharging means to form an intended electrostatic latent image.

5) the developing means 3 is not limited to a particular type.
6) the recording material which receives the toner image from the image bearing member may be an intermediary transfer member such as a transfer drum, a transfer belt.

As described in the foregoing, according to the present invention, in a cleanerless type image forming apparatus wherein the charging means comprises a charging member contacted to the image bearing member and rotated counterdirectional peripheral movement with respect to the rotation of the image bearing member, improper charging or the like attributable to excessiveness or non-uniform distribution of the electroconductive particles (charging-promotion particle) or the residual developer carried over to the contact portion between the image bearing member and the charging member, can be effectively prevented to improve or maintain the output image qualities.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

a rotatable image bearing member;

a charging rotatable member, contactable to said image bearing member at a contact position, for electrically charging said image bearing member, said charging rotatable member being rotatable for counterdirectional peripheral movement relative to rotation of said image bearing member at the contact position;

developing means for developing an electrostatic image formed on said image bearing member with a developer, said developing means being capable of collecting a residual developer from said image bearing member; and wherein a start of rotation of said charging rotatable member is simultaneous with or prior to a start of rotation of said charging rotatable member start of rotation of said image bearing member to prevent rotation of said image bearing member without rotation of said charging rotatable member prior to the start of rotation of said charging rotatable member.

2. An apparatus according to claim 1, wherein said charging rotatable member includes an elastic surface member, and electroconductive particles are provided at the contact position.

3. An apparatus according to claim 2, wherein said electroconductive particles are supplied to said image bearing member from said developing means together with the developer, and are fed to the contact position by said image bearing member.

4. An apparatus according to claim 1, wherein said elastic surface member is a foam member.

5. An apparatus according to claim 1, wherein said charging rotatable member is in the form of a roller.

6. An apparatus according to claim 1, wherein said charging rotatable member is in the form of a brush.

7. An apparatus according to claim 1, wherein the start of rotation of said image bearing member is effected after the start of rotation of said charging rotatable member and before one full-rotation of said charging rotatable member.

8. An apparatus according to claim 1, further comprising electrostatic image forming means for forming an electrostatic image, and transferring means for transferring a developed image formed on said image bearing member onto a transfer material.

9. An image forming apparatus comprising:

a rotatable image bearing member;

a charging rotatable member, contactable to said image bearing member at a contact position, for electrically charging said image bearing member, said charging rotatable member being rotatable for counterdirectional peripheral movement relative to rotation of said image bearing member at the contact position;

developing means for developing an electrostatic image formed on said image bearing member with a developer, said developing means being capable of collecting a residual developer from said image bearing member; and wherein a stoppage of rotation of said charging rotatable member is simultaneous with or subsequent to a stoppage of rotation of said image bearing member to prevent rotation of said image bearing member without rotation of said charging rotatable member after the stoppage of rotation of said charging rotatable member.

10. An apparatus according to claim 9, wherein said charging rotatable member includes an elastic surface member, and electroconductive particles are provided at the contact position.

11. An apparatus according to claim 10, wherein said electroconductive particles are supplied to said image bearing member from said developing means together with the developer, and are fed to the contact position by said image bearing member.

12. An apparatus according to claim 9, wherein said elastic surface member is a foam member.

13. An apparatus according to claim 9, wherein 5 said charging rotatable member is in the form of a roller.

14. An apparatus according to claim 9, wherein said charging rotatable member is in the form of a brush.

15. An apparatus according to claim 9, wherein the stoppage of rotation of said charging rotatable member is effected after the stoppage of rotation of said image bearing member and before one full-rotation of said charging rotatable member.

16. An apparatus according to claim 9, further comprising electrostatic image forming means for forming the electrostatic image, and transferring means for transferring a developed image formed on said image bearing member onto a transfer material.

17. An apparatus according to claim 9, wherein a start of rotation of said charging rotatable member is simultaneous with or prior to a start of rotation of said image bearing member to prevent rotation of said image bearing member without rotation of said charging rotatable member prior to the start of rotation of said charging rotatable member.

* * * * *

UNITED STATES PATENT AND TRADEMARK OFFICE

CERTIFICATE OF CORRECTION

PATENT NO. : 6,778,791 B2
DATED : August 17, 2004
INVENTOR(S) : Yasushi Shimizu et al.

It is certified that error appears in the above-identified patent and that said Letters Patent is hereby corrected as shown below:

Column 1,
Line 20, "member For" should read -- member. For --.

Column 2,
Line 20, "particle" should read -- particles --; and
Line 48, "are" should read -- is --.

Column 3,
Line 40, "transfer," should read -- transferred, --.

Column 4,
Line 10, "remains" should read -- remain --;
Line 28, "collection" should read -- collected --; and
Line 49, "scrapped" should read -- scraped --.

Column 5,
Line 2, "image so that" should read -- so that a --;
Line 4, "a" should read -- of --;
Line 5, "that" should read -- that a --;
Line 7, "does" should read -- do --; and
Line 38, "or the" should read -- of the --.

Column 6,
Line 6, "amount" should read -- amounts --; and "is" should read -- are --;
Line 15, "is" should read -- are --;
Line 17, "has" should read -- have --;
Line 23, "made" should read -- always made --;
Line 24, "always stabilize." should read -- stable --;
Line 30, "time, in" should read -- time. In --;
Line 32, "is" should read -- are --;
Line 33, "made always stabilize." should read -- always made stable. --;
Line 46, "being the" should read -- being --;
Line 48, "portion," should read -- portion, and --; and
Line 49, "occurs" should read -- occur --.

Column 7,
Line 50, "amount" should read -- amounts; --;
Line 59, "is" should read -- are --; and
Line 61, "has" should read -- have --.

UNITED STATES PATENT AND TRADEMARK OFFICE

CERTIFICATE OF CORRECTION

PATENT NO. : 6,778,791 B2
DATED : August 17, 2004
INVENTOR(S) : Yasushi Shimizu et al.

It is certified that error appears in the above-identified patent and that said Letters Patent is hereby corrected as shown below:

Column 8,
Line 12, "particle" should read -- particles --;
Line 15, "are embedded in a further extended" should read -- are further embedded --;
Line 27, "may deform" should read -- may be deformed --;
Line 30, "being the" should read -- being --;
Line 32, "portion," should read -- portion, and --;
Line 33, "occurs" should read -- occur --;
Line 37, "made" should read -- always made --;
Line 38, "always stabilizer." should read -- stable. --; and
Line 66, "particle as" should read -- particles --.

Column 10,
Line 11, "is" should be deleted.

Column 11,
Line 2, "have" should read -- and have --; and "3 $\mu$m" should read -- 3 $\mu$m, and --; and
Line 53, "they" should read -- and the --.

Column 12,
Line 42, "of the is" should read -- of the developer T is --;
Line 55, "exist" should read -- exists --; and
Line 62, "particle" should read -- particles --.

Column 13,
Line 2, "particle" should read -- particles --;
Line 33, "a" should read -- and a --; and
Line 66, "particle Z and is" should read -- particles Z --.

Column 14,
Line 10, "is" should read -- are --;
Line 21, "to" should read -- to the --;
Line 24, "leads" should read -- lead --;
Line 25, "that" should read -- that a --; and --;
Line 54, "starts" should read -- start --.

Column 15,
Line 4, "particle" should read -- particles --;
Line 18, "to" should read -- to a --;
Line 32, "tend" should read -- tends --;
Line 37, "an" should be deleted; and
Line 66, "or" should read -- of --.

UNITED STATES PATENT AND TRADEMARK OFFICE

CERTIFICATE OF CORRECTION

PATENT NO. : 6,778,791 B2
DATED : August 17, 2004
INVENTOR(S) : Yasushi Shimizu et al.

It is certified that error appears in the above-identified patent and that said Letters Patent is hereby corrected as shown below:

Column 16,
Line 8, "enter" should read -- enters --; and
Line 9, "rising" should read -- raising --.

Column 17,
Line 32, "particle Z and is" should read -- particles Z --;
Line 48, "step the" should read -- the steps of the --; and
Line 53, "leads" should read -- lead --; and "that" should read -- that a --.

Column 18,
Line 16, "stops" should read -- stop --; and
Line 39, "particle" should read -- particles --.

Column 19,
Line 63, "The" should read -- the --.

Column 20,
Line 11, "by" should read -- by a --;
Line 52, "start of" should be deleted; and
Line 53, "rotation of said charging rotatable member" should be deleted.

Column 22,
Line 12, "wherein 5" should read -- wherein --.

Signed and Sealed this

Sixteenth Day of November, 2004

JON W. DUDAS
*Director of the United States Patent and Trademark Office*